United States Patent [19]

Glasson

[11] 4,024,805

[45] May 24, 1977

[54] MACHINE FOR COMPACTING AND TYING COILS

[75] Inventor: Jean Emile Glasson, Cormeilles-en-Parisis, France

[73] Assignee: Botalam, Paris, France

[22] Filed: Nov. 25, 1975

[21] Appl. No.: 635,040

[30] Foreign Application Priority Data

June 12, 1974 France ..... 74.40018

[52] U.S. Cl. ..... 100/12; 100/3; 100/7; 100/26

[51] Int. Cl.[2] ..... B65B 13/04

[58] Field of Search ..... 100/3, 7, 26, 12; 140/93.6

[56] References Cited

UNITED STATES PATENTS

| | | | |
|---|---|---|---|
| 2,920,553 | 1/1960 | Van Marle | 100/27 |
| 3,548,739 | 12/1970 | Glasson | 100/7 |
| 3,929,062 | 12/1975 | Thompson | 100/3 |

*Primary Examiner*—Billy J. Wilhite
*Attorney, Agent, or Firm*—Lane, Aitken, Dunner & Ziems

[57] ABSTRACT

A machine for compacting and tying coils comprises a compacting unit mounted for movement in the direction of a tying unit, which itself includes a supply of tying wire. The tying wire is supplied to wire guide channels adapted to close around the compacting coil in order to make ties. The tying unit also has twisting heads for tying two ends of each tie after the corresponding wire has been pulled. Each guide channel is associated with at least two retractable rollers disposed on the movable compacting unit adjacent its support surface bearing against the coil and on each side of the latter, for the purpose of supporting the tying wire while it is being pulled.

4 Claims, 7 Drawing Figures

MACHINE FOR COMPACTING AND TYING COILS

This invention relates to machines for compacting and tying coils.

One known machine for compacting and tying coils comprises a compacting unit mounted for movement towards a tying unit for the purpose of compacting a coil between a fixed support surface provided on the tying unit and a movable support surface provided on the compacting unit, and tying unit comprising means for supplying tying wire to a plurality of wire guide channels adapted to close around the compacted coil for the purpose of making ties thereon, and a twisting head for tying the two ends of each tie after pulling the corresponding wire.

In this known machine the coils are very often marked at the sites of the ties, so that the first turns are generally unusable and have to be discarded which obviously constitutes a not inconsiderable wastage of material. This marking, which is made by removing a more or less considerable amount of metal from the section of the turn, is due to the fact that when one of the ends of the tying wire is pulled in order to bring it out of the corresponding guide channel and to tighten it around the coil the wire rubs against the edges of the coil, so that a tying action takes place which cuts to a greater or lesser extent into the top turns. This rubbing action is obviously greater at points nearer the side where the wire is pulled out, because the length of wire rubbing on the coil is then also greater. On the other hand there is practically no rubbing action on the opposite side because the corresponding end of the tying wire is fixed.

According to the present invention there is provided a machine for compacting and tying coils, comprising: a tying unit; and a compacting unit mounted for movement towards the tying unit for compacting a coil between a fixed support surface provided on the tying unit and a movable support surface provided on the compacting unit, the tying unit comprising means for supplying tying wire to a plurality of wire guide channels arranged to close around the compacted coil in order to make the ties thereon, and twisting means for tying the free ends of each tie after the respective wire has been pulled, each guide channel being associated with at least a pair of retractable rollers disposed on the compacting unit adjacent said movable support surface and arranged to bear against the coil on each side thereof to support the tying wire whilst it is being pulled.

A third retractable roller is preferably provided on the tying unit adjacent the said fixed support surface for supporting the tying wire at a point on the side of the coil on which the wire is pulled.

It will readily be appreciated that as a result of these arrangements the coil is unlikely to be marked by the tie wire. The rollers will, in fact, completely support the tying wire whilst it is being pulled, and optionally also while the ends are being tied by the twisting means. When the ties have thus been made, it is obviously sufficient to retract the rollers, whereupon the relaxing of the coil will automatically retighten the ties without effecting the slightest marking.

In one embodiment of the present invention each said pair of rollers are carried by a common plate pivotally mounted in the compacting unit.

The third roller may be carried by a support rigidly fixed to a sleeve mounted for rotation about a central shaft, the sleeve carrying the third roller of each of the other guide channels.

It is possible for all the rollers to be simultaneously retracted by means of a single operating means, comprising, for example, a power cylinder.

The invention is illustrated, merely by way of example, in the accompanying drawings, in which.

Figure 1:
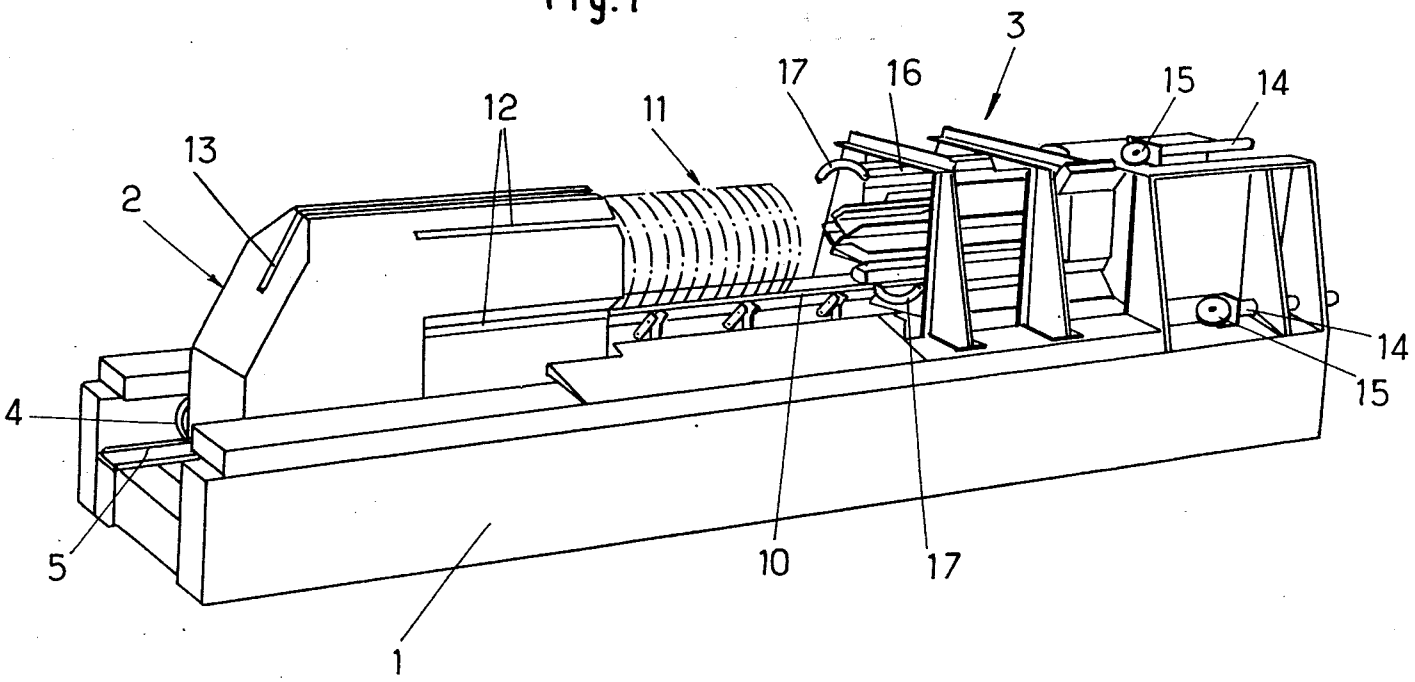
FIG. 1 is a simplified perspective view of a horizontal machine according to the present invention for compacting and tying coils.

In the following description the terms "front," "rear," "top" etc. refer to the directions as seen in the drawings.

Figure 2:
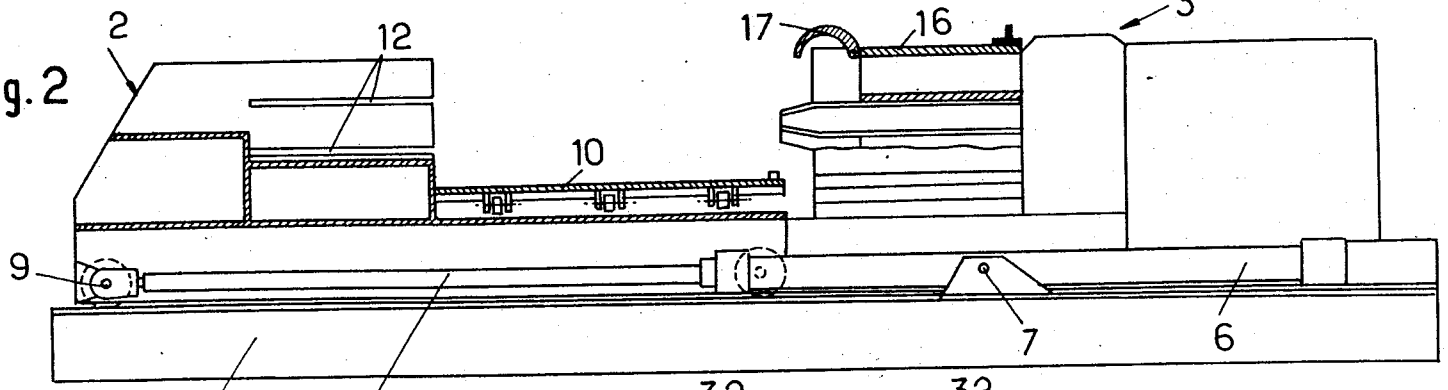
FIG. 2 is a simplified view of the machine of FIG. 1 in longitudinal section.

A machine according to the present invention for compacting and tying coils and illustrated in FIGS. 1 and 2, is of the horizontal type and comprises a fixed elongated frame 1 on which are mounted the various elements of the machine. A movable compacting unit 2 is disposed at one end of the frame 1 and a tying unit 3 is fixed at the other end.

The compacting unit 2 consists of a carriage arranged to move longitudinally relative to the frame 1, this longitudinal movement being effected by wheels 4 cooperating with guide rails 5. The carriage is moved by means of a hydraulic ram whose cylinder 6 is pivoted to the frame at a point 7 and whose rod 8 is pivoted at its free end on the carriage at a point 9.

The front portion of the compacting unit 2, that it is say the portion facing the tying unit 3, is composed of a receiving cradle 10 on which coils 11 which are to be compacted and tied are placed by means of a hook type overhead conveyor (not shown). The rear portion of the compacting unit has a central cavity which is adapted to receive the coils and which is in communication with the exterior by means of four longitudinal slots 12 which are angularly spaced apart by 90°. A longitudinal slot 13 is also provided on the top of the carriage in order to permit the passage of a hook or hooks of the overhead conveyor during placing of the coils 11 on the cradle 10.

The tying unit 3 comprises means 14, 15 for supplying and storing tying wire, these means being shown diagrammatically in FIG. 1. The tying unit also includes conventional means (not shown) for pulling the wire in order to tighten the tie around the coils 11 when they have been compacted, as will be explained. The means 14, 15, are associated with a plurality of identical guide channels 16 of known construction one of which is shown in greater detail in FIG. 3.

Figure 3:
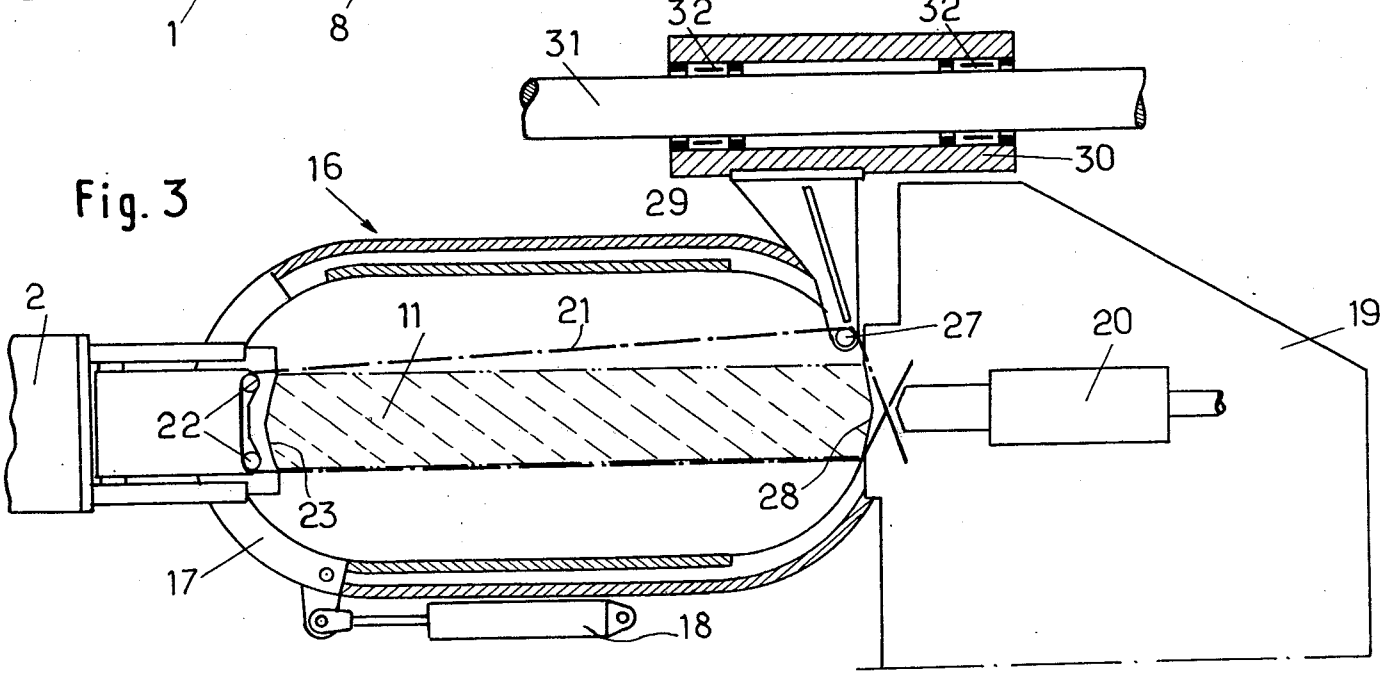
FIG. 3 is a plan view of part of the machine of FIG. 1 showing one of a plurality of guide channels thereof with three retractable rollers.

In the illustrated embodiment there are four of the channels 16, corresponding respectively to the four slots 12 of the compacting unit 2. Each of the channels 16 is adapted to surround the compacted coil completely with the aid of a movable crescent 17 which is provided at its end and which is adapted to close contiguously through the respective slot 12 under the action of a power cylinder 18, so as to form a continuous channel as illustrated in FIG. 3.

At the opposite end of the channel 16 is disposed a conventional tying head 19, consisting of a twisting head 20 adapted to tie together, in a conventional manner, the two ends of the tie formed around the compacted coil 11 by tying wire 21 supplied by the means 14, 15.

Each of the channels 16 is associated with two retractable rollers 22 carried by the compacting unit 2. These rollers are disposed near a front face 23 of the compacting unit 2 and are spaced apart by a distance substantially equal to the radial thickness of the compacted coil.

Figure 4:
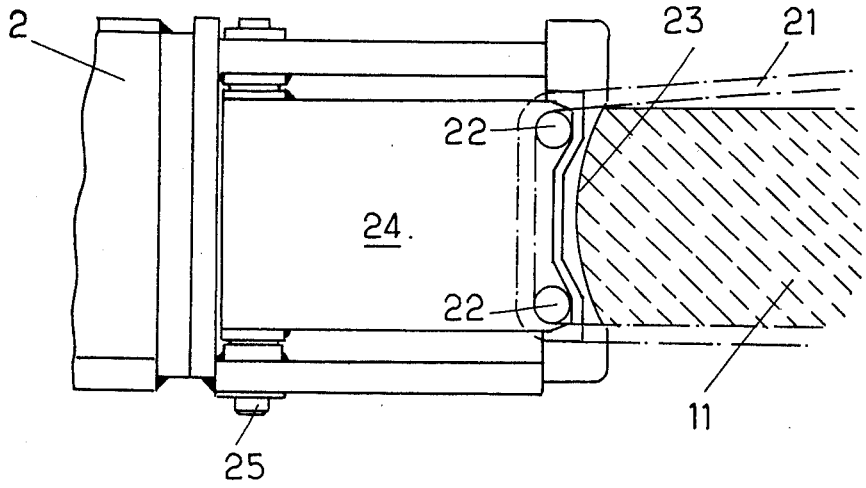
FIGS. 4 and 5 are detailed views on a larger scale, illustrating the operation of two of the rollers of FIG. 3.
Figure 5:
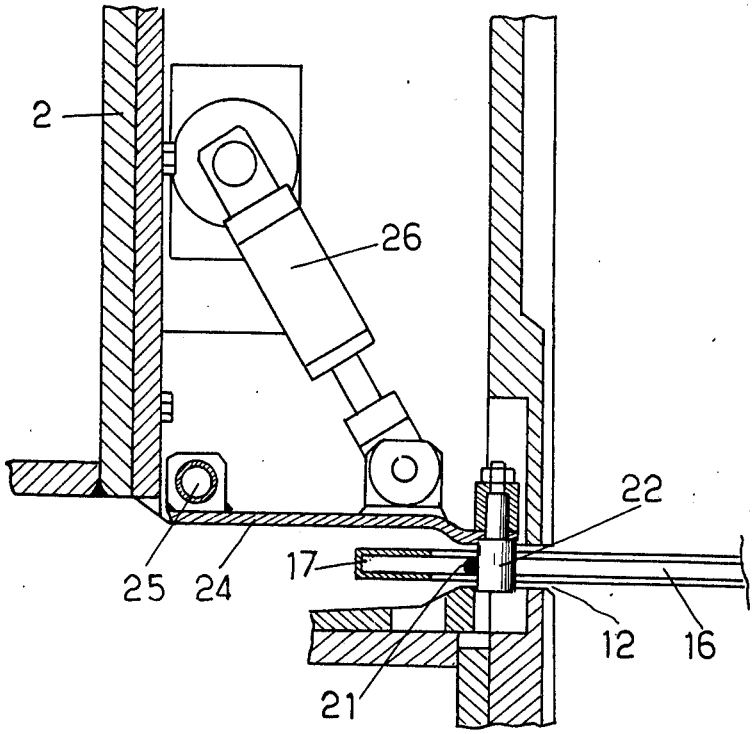

As can be seen more clearly in FIGS. 4 and 5, the rollers 22 are carried by a common plate 24 which is mounted for pivotal movement about a pivot pin 25 on the compacting unit 2. An operating cylinder 26 is provided for the purpose of pivoting the plate 24 about its axis, in order to bring the rollers 22 through the slots 12 and into the path of the tying wire 21, that is to say into the plane of the corresponding channel 16, and in order to remove them from this plane.

Each of the channels 16 is, in addition, associated with a third retractable rotatable roller 27 carried by the tying unit 3. Each roller 27 is disposed near a fixed support surface 28 of the tying unit 3 and is disposed laterally on the side where the tying wire 21 is pulled, that is to say in the present embodiment, on the inner side.

Figure 7:
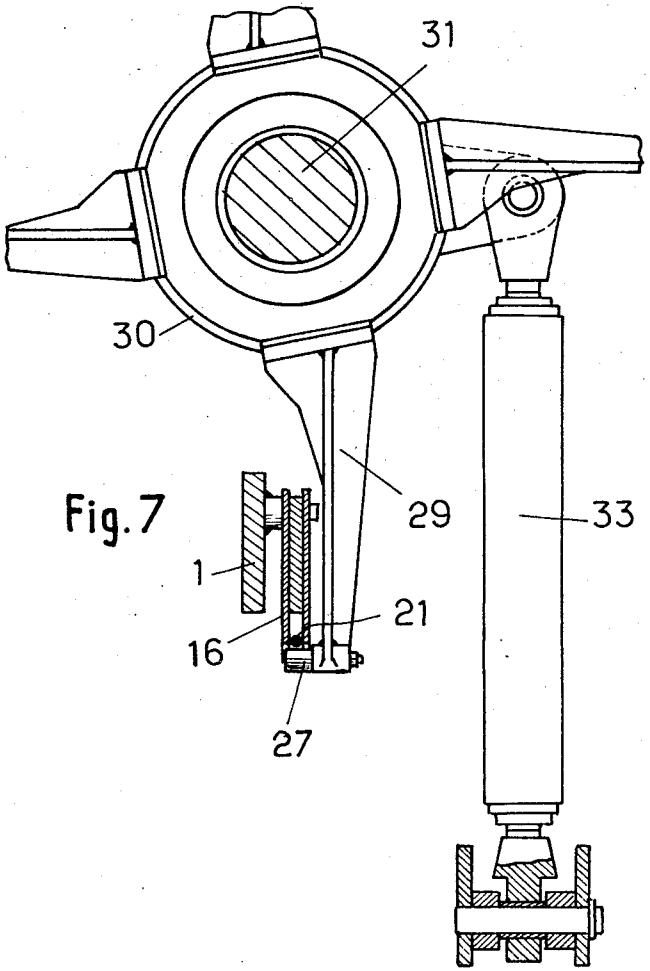
FIG. 6 and 7 are detailed views on a larger scale illustrating the operation of the third roller of FIG. 3.
Figure 6:
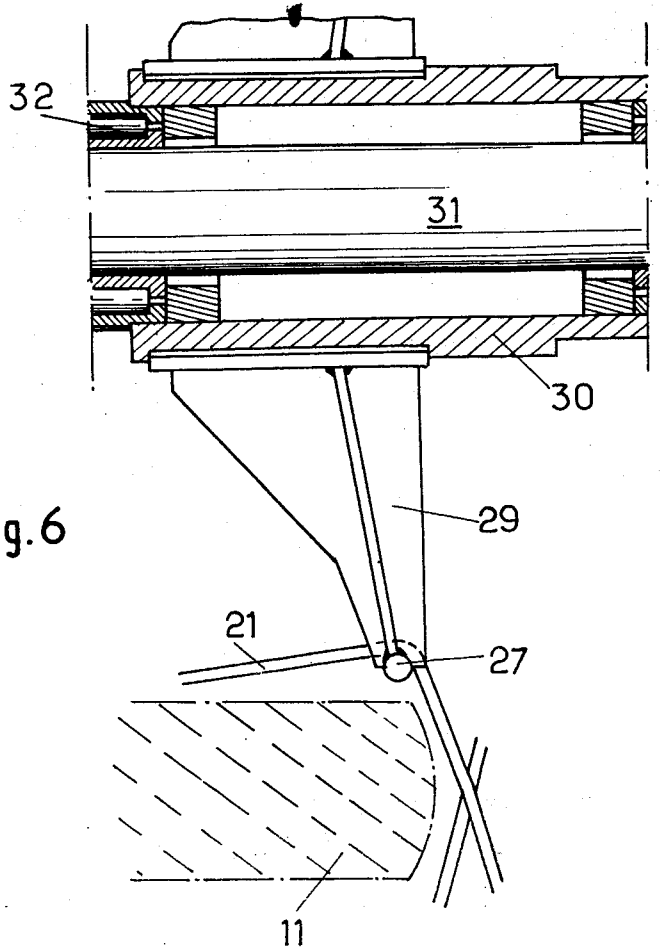

As can be seen more clearly in FIGS. 6 and 7, each roller 27 is carried by the end of a support 29 rigidly fastened to a sleeve 30 which is mounted for rotation in needle bearings 32 on a central shaft 31 of the tying unit. It will be noted that the sleeve 30 is rigidly connected to three other supports, such as the support 29, disposed at angles of 90° to one another, these supports carrying the rollers 27 of the respective other three channels 16. By means of a single power cylinder 33 this arrangement enables the four rollers 27 to be moved simultaneously in order to bring them into or retract them from the path of the tying wire 21.

The operation of the machine of FIG. 1 will now be briefly described so that its advantages will be more clearly appreciated.

At the outset, the compacting unit 2 is in a withdrawn position on the frame 1, as illustrated in FIGS. 1 and 2, and the crescents 17 of the channels 16 are held in an open position by the cylinders 18.

The overhead conveyor deposits a coil or a packet of coils 11 on the cradle 10, and the ram 6 driving the compacting unit 2 is then operated. The compacting unit 2 then advances towards the tying unit 3 and thus compacts the coil 11 between the support surfaces 23, 28. At the same time the hook of the overhead conveyor slids along the slot 13 as the compacting unit advances, and is thus disengaged.

When the rear portion of the compacted coil 11 passes the position of the crescent 17, the cylinders 18 are operated. The crescents are then moved to a closed position through the slots 12 of the carriage, so as to complete the four channels 16 for the tying unit, these channels then completely surrounding the coil.

A predetermined length of tying wire 21 is then supplied to each of the channels 16 by the means 14, 15. In the conventional manner, a heavy pull is then applied to one of the ends of each tying wire, this end corresponding to the inside portion of the wire, whilst the other end is secured by means (not shown) provided on the tying head 19. In doing so, the wire 21 passes out of the previously opened guide channel 16 and then is immediately applied against the rollers 22, 27, which are situated precisely in its plane and over which it is thus further pulled.

It will thus readily be appreciated that the compacted coil definitely cannot be locked by the tying wire when the latter is pulled. The wire is, in fact, held at a distance from the coil by the rollers 22, 27 and therefore cannot rub against the coil, except, perhaps, on the side against which the end of the wire which is immobilized during the pulling is situated. It would, moreover, be possible to provide a fourth roller at that point, this roller being similar to the roller 27 and being disposed symmetrically with respect thereto. Experience nevertheless shows that this is not essential. When the wire is immobilized, there is, in fact, actually no friction and the wire is simply applied against the coil without effecting any marking thereof.

When the tying wire is effectively tensioned on the rollers 22, 27, the twisting heads 20 are operated, so as to tie the two ends of the tying wires together in the conventional manner, thus forming four strong ties around the coil. It is then sufficient to retract the rollers 22, 27 by means of the cylinders 26, 33, and the coil 11 will automatically retighten the ties as it expands when it is freed from the grip of the compacting unit 2. For this purpose it is moreover possible for the coil to be compacted to a greater extent than necessary when the tying wire is tensioned on the rollers 22, 27, in order subsequently to obtain ties which are very tight.

It is obviously also possible to retract the rollers 22, 27, supporting the tying wire 21 before operating the twisting heads 20. Since the tying wire is then situated close to the coil 11, there is, in fact then actually no risk that it will be marked when the wire is applied against it, and in this way it is possible to make the ties directly on the coil, as in machines used up to the present time.

Finally, the compacting unit 2 is brought back to the withdrawn position by the ram 6, after the crescents 17 have been moved to the open position, and the tied coil can then be discharged without difficulty from the receiving cradle 10, this freeing the machine for a new operating cycle.

To sum up, it can consequently be seen that with the aid of its retractable rollers 22, 27 the machine described above makes it possible for previously compacted coils of wire to be tied very easily without damaging the top turns, and therefore without any loss or wastage of material.

It will be appreciated that although the present invention has been described herein in connection with a machine of the horizontal type it is equally applicable to a machine of the vertical type.

What is claimed is:

1. A machine for compacting and tying coils comprising: a tying unit; a fixed supporting surface on said tying unit; a compacting unit having a movable supporting surface, said compacting unit being mounted for movement towards said tying unit for compacting a coil between said fixed and said movable supporting surfaces; means for supplying tying wire to said tying unit; a plurality of wire guide channels on said tying unit in cooperative relationship with said means for supplying tying wire and adapted to close around the compacted coil for guiding the tying wire around the compacted coil; a plurality of pairs of retractable rollers disposed on said compacting unit adjacent said movable supporting surface, each of said pairs of retractable rollers being positioned in cooperative relationship with each of said plurality of guide channels and arranged to bear against the sides of the compacted coil to support the tying wire while the wire is pulled across the coil; and twisting means for tying the free ends of each tie after the tying wire has been pulled across the compacted coil.

2. A machine as claimed in claim 1 further comprising a plate pivotally mounted on said compacting unit for supporting each of said pairs of retractable rollers.

3. A machine as claimed in claim 1 further comprising a plurality of third, retractable rollers provided on said tying unit adjacent said fixed supporting surface, a third, retractable roller associated with each of said guide channels for supporting the tying wire at a point on the side of the coil on which the tying wire is pulled.

4. A machine as claimed in claim 1 further comprising: a shaft attached to said tying unit; a sleeve rotatably mounted on said shaft; and a support rigidly fixed to said sleeve, said support carrying said third retractable rollers.

* * * * *